US008484780B1

(12) United States Patent
Edgerton

(10) Patent No.: US 8,484,780 B1
(45) Date of Patent: Jul. 16, 2013

(54) HEIGHT ADJUSTABLE APPARATUS WITH RADIUS ARM AND IDLERS

(75) Inventor: John Edgerton, Omro, WI (US)

(73) Assignee: GF Health Products, Inc., Atlanta, GA (US)

( * ) Notice: Subject to any disclaimer, the term of this patent is extended or adjusted under 35 U.S.C. 154(b) by 980 days.

(21) Appl. No.: 12/274,320

(22) Filed: Nov. 19, 2008

(51) Int. Cl.
*A47B 7/02* (2006.01)

(52) U.S. Cl.
USPC ..... 5/611; 296/20

(58) Field of Classification Search
USPC ..... 5/11, 86.1, 607, 611, 613, 617, 618, 5/620, 625–627; 296/20
See application file for complete search history.

(56) References Cited

U.S. PATENT DOCUMENTS 3,003,159 A 10/1961 Hebert et al.
3,644,945 A * 2/1972 Goodman et al. ..... 5/616
4,062,075 A 12/1977 Stern et al.
5,303,437 A 4/1994 Hung
5,544,375 A 8/1996 Urness et al.
6,161,236 A 12/2000 Carroll
6,363,556 B1 * 4/2002 Krauska et al. ..... 5/618
6,405,393 B2 6/2002 Megown
6,851,144 B2 2/2005 Wang
6,868,567 B2 3/2005 Edgerton
7,134,155 B2 * 11/2006 Freeborn et al. ..... 5/611
2002/0066142 A1 6/2002 Osborne et al.
2006/0021143 A1 2/2006 Lemire
2006/0026762 A1 2/2006 Hornbach et al.
2006/0123545 A1 6/2006 Johnson
2010/0064441 A1 * 3/2010 Barthelt ..... 5/616

* cited by examiner

*Primary Examiner* — Robert G Santos
*Assistant Examiner* — Nicholas Polito
(74) *Attorney, Agent, or Firm* — Brannen Law Office, LLC

(57) ABSTRACT

The invention has a deck that is supported by a first lever and a second lever. The first and second levers can be connected with a drag link. An actuator can be pivotally connected relative to but not directly to the deck. The location of the actuator relative an arm of the first lever is controlled with a control arm. A caster carriage and four idlers can also be provided. The idlers pivotally interconnect the first and second levers with the caster carriage. A radius arm can be connected to the caster carriage and to an arm of one of the levers. In this regard, the radius arm can be relatively long and can act in tandem with the respective lever and the idlers to minimize the horizontal shifting of the deck as the apparatus is raised and lowered.

15 Claims, 9 Drawing Sheets

HEIGHT ADJUSTABLE APPARATUS WITH RADIUS ARM AND IDLERS

BACKGROUND OF THE INVENTION

1. Field of the Invention

The present invention relates to an apparatus, such as a bed, having a vertically adjustable deck that is selectably raised and lowered in a substantially vertical manner as a radius arm, levers and idlers act in tandem to minimize horizontal shifting of the deck during operation.

2. Description of the Related Art

Typically, height and angle adjustable beds are used by medical institutions, such as hospitals and nursing homes. The beds usually include a bed frame and an articulating mechanism for lowering the bed frame to a low position and raising the bed frame to a high position so that it may be used as a gurney or at any height in between. As a result, a patient can be transferred by merely sliding the patient from one gurney to another or a chair.

It is known to have height and angle adjustable beds that may be lowered to a fully lowered position near the floor; however, such beds may require a mechanical or hydraulic compression assist mechanism or high-power hydraulic lift mechanisms to lift the bed from the fully lowered position. For example, U.S. Pat. No. 6,405,393 to Megown ("the '393 patent"), the contents of which are hereby incorporated herein reference, discloses a spring assist mechanism that allows a height adjustable bed to rise from a fully lowered position. The '393 patent describes the increase in force necessary to raise the bed from the fully lowered position. This is because as the angle between the linear actuator and the bed frame in the bed shown in the '393 patent approaches zero, the cosine of that angle also approaches zero. As the cosine of the angle approaches zero, the resultant lift component, or vertical component, of the actuator force also approaches zero. The actuator is therefore at a mechanical disadvantage when the cosine of the angle approaches zero. A mechanical or hydraulic compressive assist mechanism may be used to overcome the mechanical disadvantage. However, such components may fail unexpectedly. In addition, when such mechanisms fail, time delay, damage or injury may occur. Thus, it would be desirable to eliminate any need for mechanical and hydraulic compressive assist mechanisms.

A further disadvantage of some existing angle adjustable beds is that they comprise two motors acting in parallel. The additional force of multiple motors acting in parallel can be useful for overcoming the mechanical disadvantage created at the low positions. Yet, use of two motors in parallel can be disadvantageous as the two motors can get out of synchronization. In this regard, either motor may raise or lower a respective end of the bed at a different rate. This could jeopardize the health and safety of any person on the bed. Further, such a drawback could make transport during raising and lowering of the bed impractical and hazardous. Further, while having two motors acting in parallel may be beneficial in overcoming the mechanical disadvantage at the low position, their use can be inefficient.

A still further disadvantage yet of existing angle adjustable beds is that they may require an undesirably large amount of swing to reposition the bed from the lowered position to the raised position. The swing occurs as a result of the support frame of the bed moving forward or rearward relative to the wheels. A large swing is disadvantageous for several reasons. First, having bed frame move forward or rearward relative to the wheels changes the center of gravity of the bed. The larger the swing, the larger the change in the center of gravity of the bed. Second, with the ever increasing pressure to reduce room size and to fit more items into existing rooms, there is a sizable disadvantage to a bed that requires a relatively large amount of swing to raise the bed to the raised position and/or lower the bed to a lowered position.

An additional example of a bed is disclosed in U.S. Pat. No. 6,363,556 to Krauska et al. This patent, titled Linkage for an Articulating Bed, describes a stabilizer link pivotally connected on opposite ends to the base frame and to the mattress frame. The connection point of the mattress frame rotates about the connection point of the base frame as the bed is raised and lowered. In the regard, the mattress frame has an undesirable amount of swing relative the base frame. Idler links are provided between lever members and the base frame in an attempt to minimize the horizontal movement of the mattress frame. Yet, horizontal shifting is still present in that invention.

Thus there exists a need for an apparatus such as a bed that solves these and other problems.

SUMMARY OF THE INVENTION

The present invention relates to an apparatus, such as a bed, having a vertically adjustable deck that is selectably raised and lowered in a substantially vertical manner as a radius arm, lever and idlers act in tandem to minimize horizontal shifting of the deck during operation.

In one preferred embodiment, the invention has a mainframe and a deck, hereafter referred to collectively as a deck. The deck is supported by a first lever and a second lever. The first lever can have four arms that rotate about a central rotational axis, and can have an interface such as a track, slide or slot in the third arm. The first and second levers can be connected with a drag link. An actuator can be pivotally and slideably or movably connected to the first lever, in the interface, and pivotally connected to the drag link. In this regard, the actuator is pivotally connected relative to but not directly to the deck. The location of the actuator relative the third arm interface is controlled with a control arm. Movement of the actuator relative the third arm interface can change the effective length of the third arm of the first lever.

A caster carriage and four idlers can also be provided. The idlers pivotally interconnect the first and second levers with the caster carriage. A radius arm can be connected to the caster carriage and to an arm of one of the levers. In this regard, the radius arm can be relatively long and can act in tandem with the respective lever and the idlers to minimize the horizontal shifting of the deck as the apparatus is raised and lowered.

According to an advantage of the present invention, the deck can rise in a vertical or near vertical manner. This is accomplished in a preferred embodiment by having the horizontal shift caused by the lever and idlers be approximately equal and opposite of the horizontal shift caused by the radius arm. Accordingly, the shift from the idlers and the radius arm effectively cancel each other out resulting in generally vertical rise.

Other advantages, benefits, and features of the present invention will become apparent to those skilled in the art upon reading the detailed description of the invention and studying the drawings.

DETAILED DESCRIPTION OF THE PREFERRED EMBODIMENTS

Figure 1:
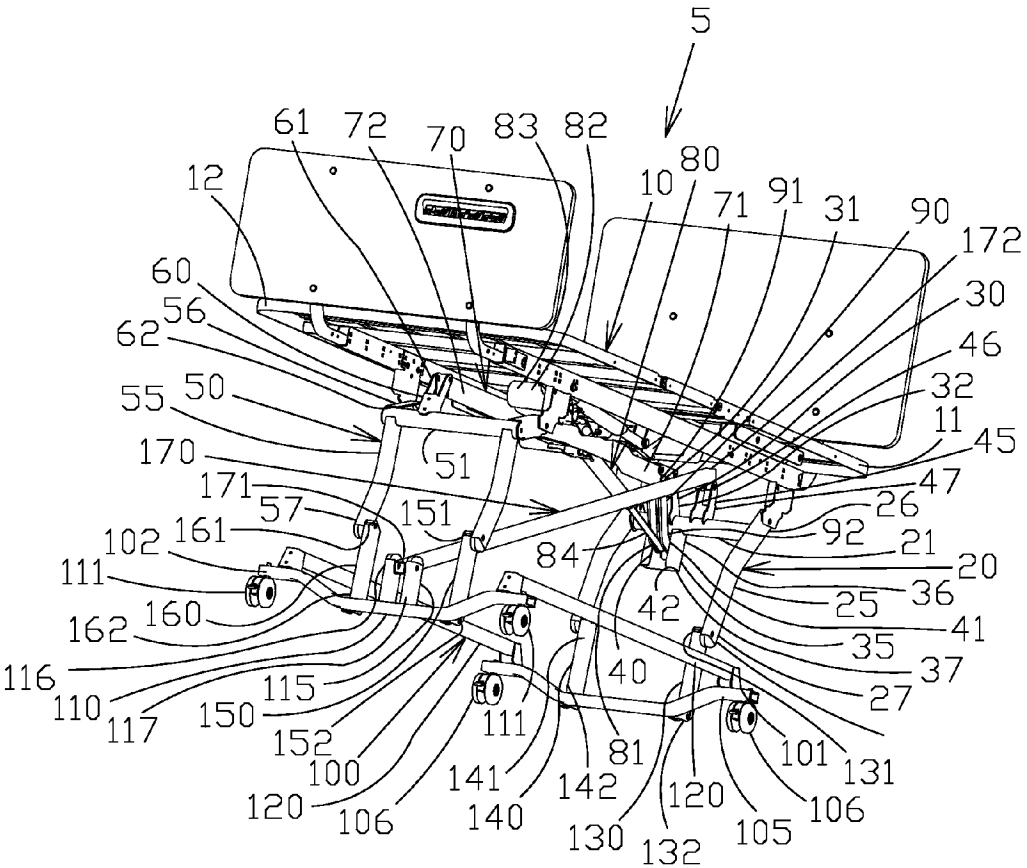
FIG. 1 is a perspective view of a preferred embodiment of the present invention in a high position.

While the invention will be described in connection with one or more preferred embodiments, it will be understood that it is not intended to limit the invention to those embodiments. On the contrary, it is intended to cover all alternatives, modifications and equivalents as may be included within the spirit and scope of the invention as defined by the appended claims.

A bed 5 is provided according to one embodiment of the present invention as shown in FIGS. 1-9. The bed 5 has a main-frame and deck, hereafter referred to collectively as a deck 10. The deck 10 has a first end 11 and a second end 12.

A first lever 20 is preferably at the first end 11 of the deck 10. The first lever 20 has arms 25, 30, 35 and 45. The arms 25, 30, 35 and 45 are rigidly connected to a cross-beam 21. The arms 25, 30, 35 and 45 rotate about a central axis at the same rate. The cross-beam 21 need not be concentric with the central axis. Arm 25 has a first end 26 and a second end 27. Arm 30 has a first end 31 and a second end 32. Arm 35 has a first end 36 and a second end 37. Arm 35 further has an interface or path formed therein. One preferred interface is a track 40 or slide or slot. It is appreciated that other interfaces, such as a cam and follower could be used without departing from the broad aspects of the present invention. Track 40 has a first end 41 and a second end 42. Track 40 can be straight or curved. The first end 26 of arm 25, or deck arm, is preferably pivotally connected to the deck 10.

A second lever 50 is preferably at the second end 12 of the deck 10. The second lever 50 has arms 55 and 60. Arms 55 and 60 are rigidly connected to a cross-beam 51. The arms 55 and 60 rotate about a central axis at the same rate. The cross-beam 51 and central axis need not be concentric. Arm 55 has a first end 56 and a second end 57. Arm 60 has a first end 61 and a second end 62. Arm 55, or deck arm, connects to the deck 10. A drag link 70 is provided for connecting the first lever 20 and the second lever 50. The drag 70 has a first end 71 and an opposed second end 72. The first end 71 of the drag link 70 is pivotally connected to the first end 31 of arm 30, or drag link arm. The second end 72 of the drag link 70 is pivotally connected to the first end 61 of arm 60, or drag link arm.

An actuator 80 is further provided. The actuator has a first end 81 and a second end 82. The actuator 80 further has a motor 83 and a linear shaft 84. In the preferred embodiment, the actuator 80 is an electrically powered actuator. The motor 83 is at the second end 82 of the actuator 80, and can be pivotally connected to the drag link 70 at a point intermediate the ends 71 and 72. The first end 81 of the actuator 80 is preferably pivotally connected to arm 35, or interface arm, of the lever 20. Further, the first end 81 of the actuator is slideably or movably received within track 40 between the first end 34 and second end 34. It is further understood that while the actuator 80 is shown in one orientation relative the drag link 70 and arm 30, that the opposite orientation (motor 83 near arm 30) could be utilized without departing from the broad aspects of the present invention.

A control arm 90 is provided. The control arm has a first end 91 and a second end 92. The first end 91 is pivotally connected to the drag link 70. The second end 72 is pivotally connected to end 81 of the actuator 80. The control arm 90 controls the location of the end 81 of the actuator 80 within the track 40.

Figure 5:
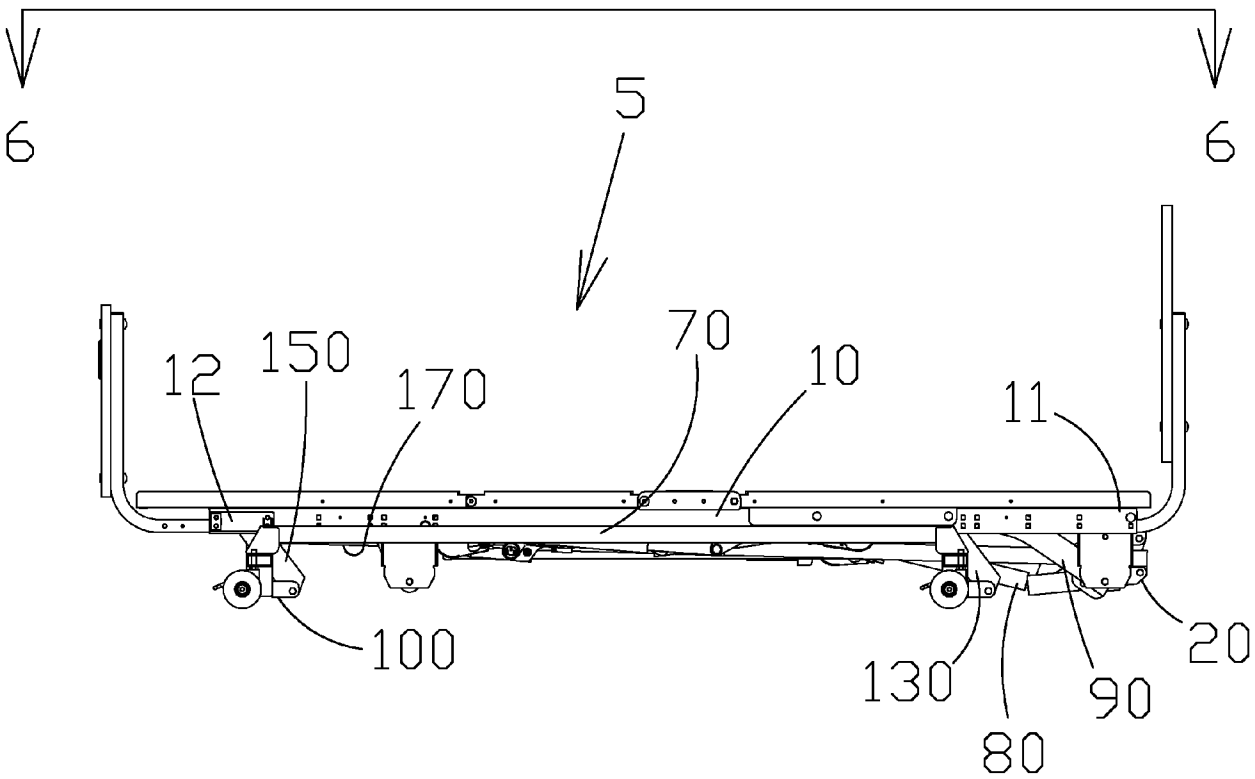
FIG. 5 is a side view of the preferred embodiment of the present invention shown in FIG. 1 in a low position.
Figure 6:
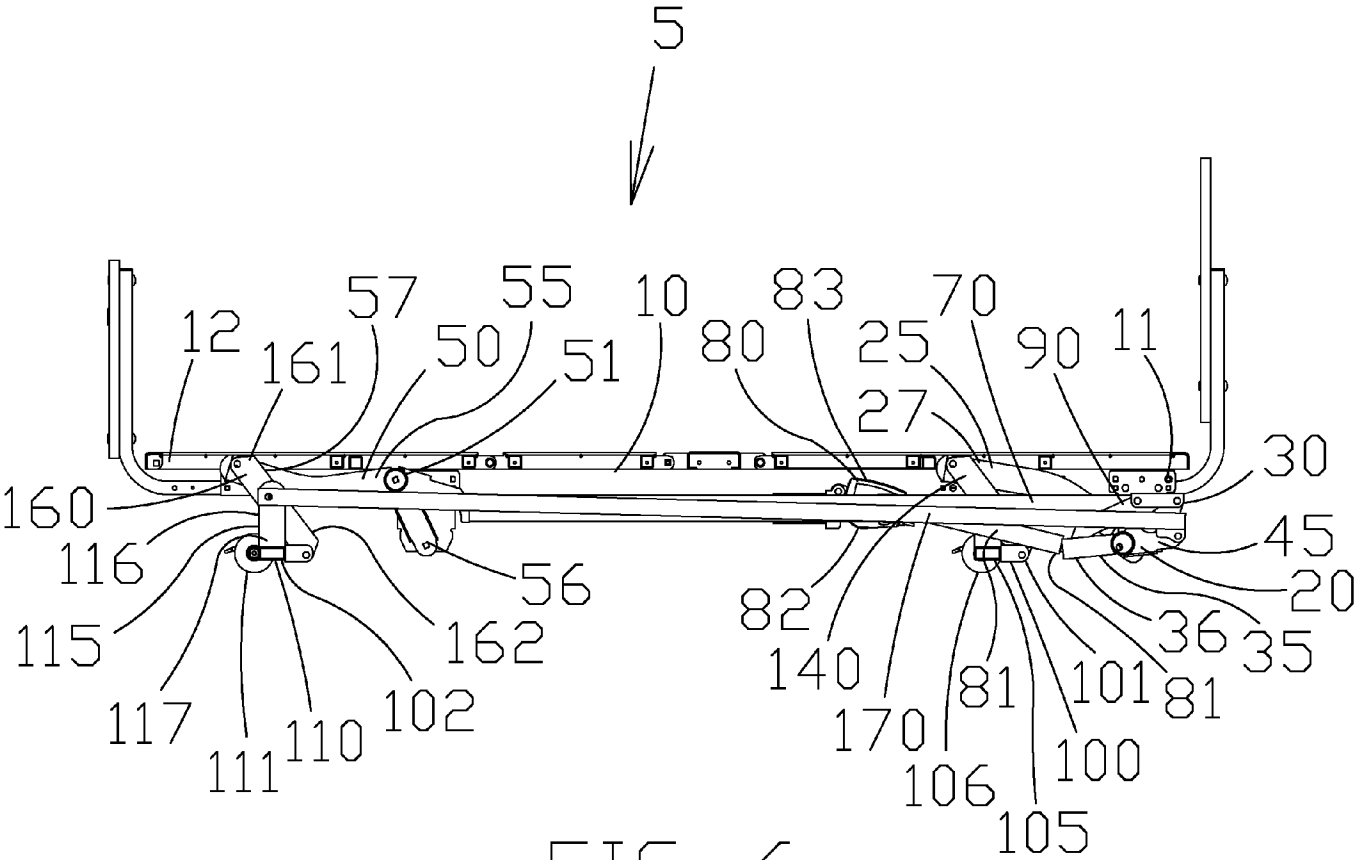
FIG. 6 is a side section view taken along line 6-6 in FIG. 5.
Figure 9:
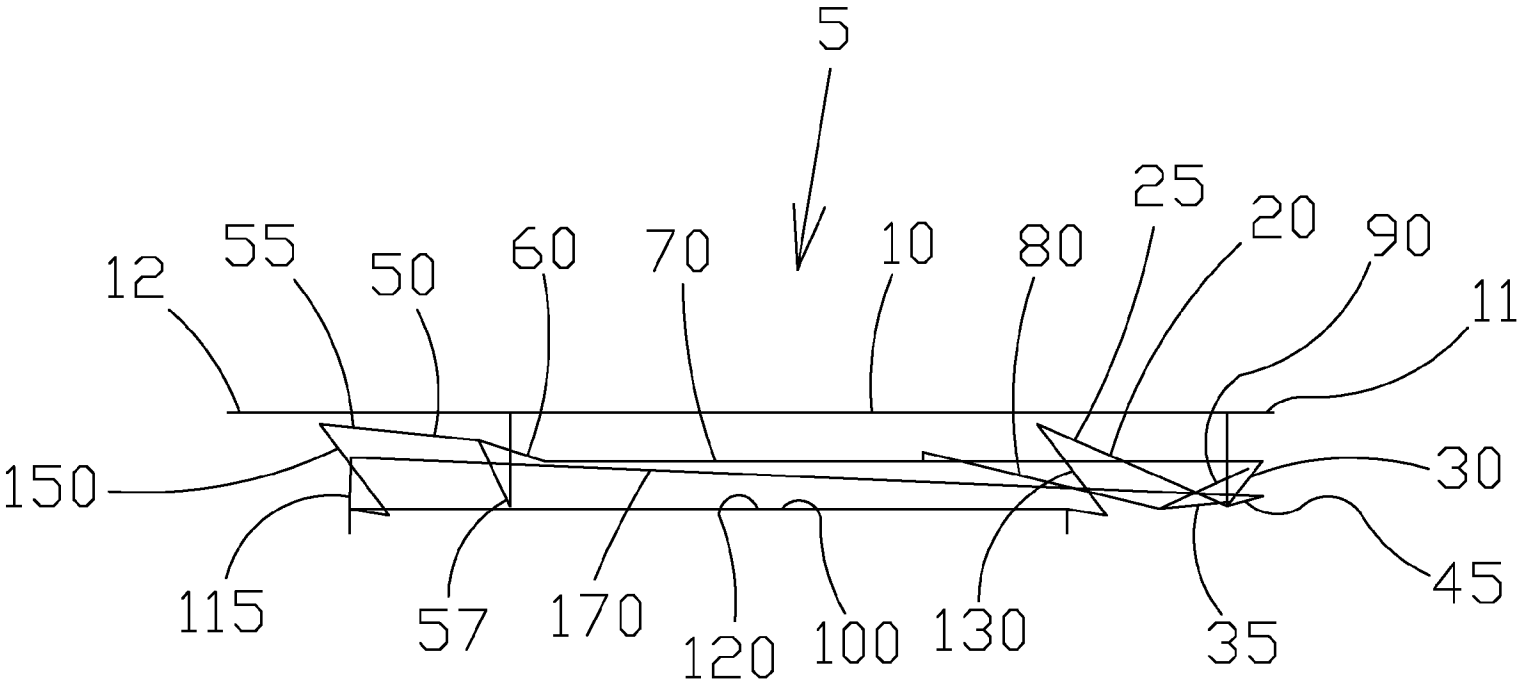
FIG. 9 is schematic view of the preferred embodiment of the present invention shown in FIG. 1 in a low position.

When the bed is collapsed, or in the low position, as shown in FIGS. 5, 6 and 9, the control arm 90 dictates that the first end 81 of the actuator 80 be positioned at the second end 42 of the track 40. In this position, the effective length of arm 35 is maximized. The length of the arm 35 determines the ratio of lift in the bed 5 relative stroke of the actuator 80. At the low position, a large amount of force is required to lift the bed 5 a small amount. The large effective length allows for a relatively large amount of torque to be created. A maximum effective length is therefore desirable so that the actuator 80 can act at or near peak efficiency.

Figure 3:
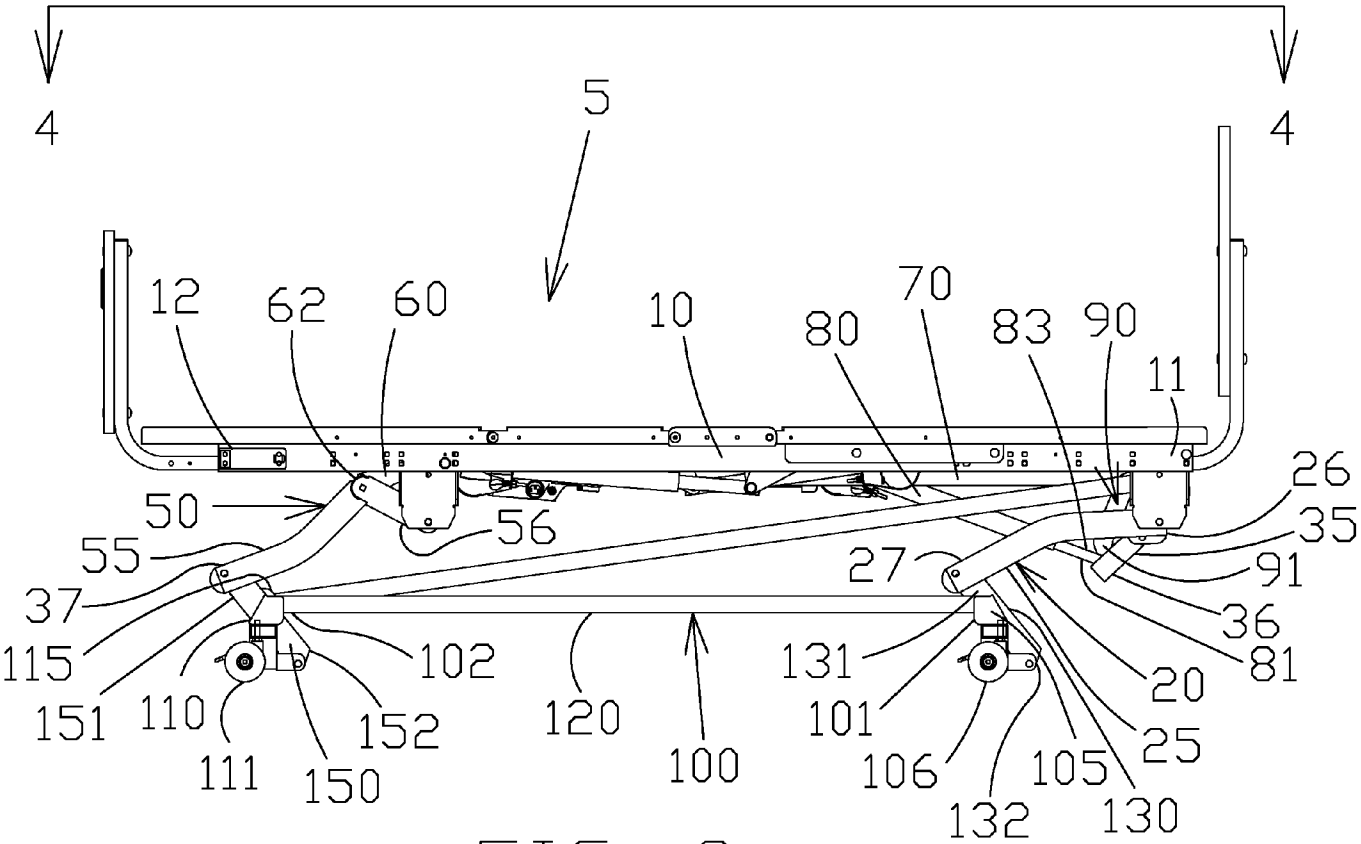
FIG. 3 is a side view of the preferred embodiment of the present invention shown in FIG. 1 in a mid position.
Figure 4:
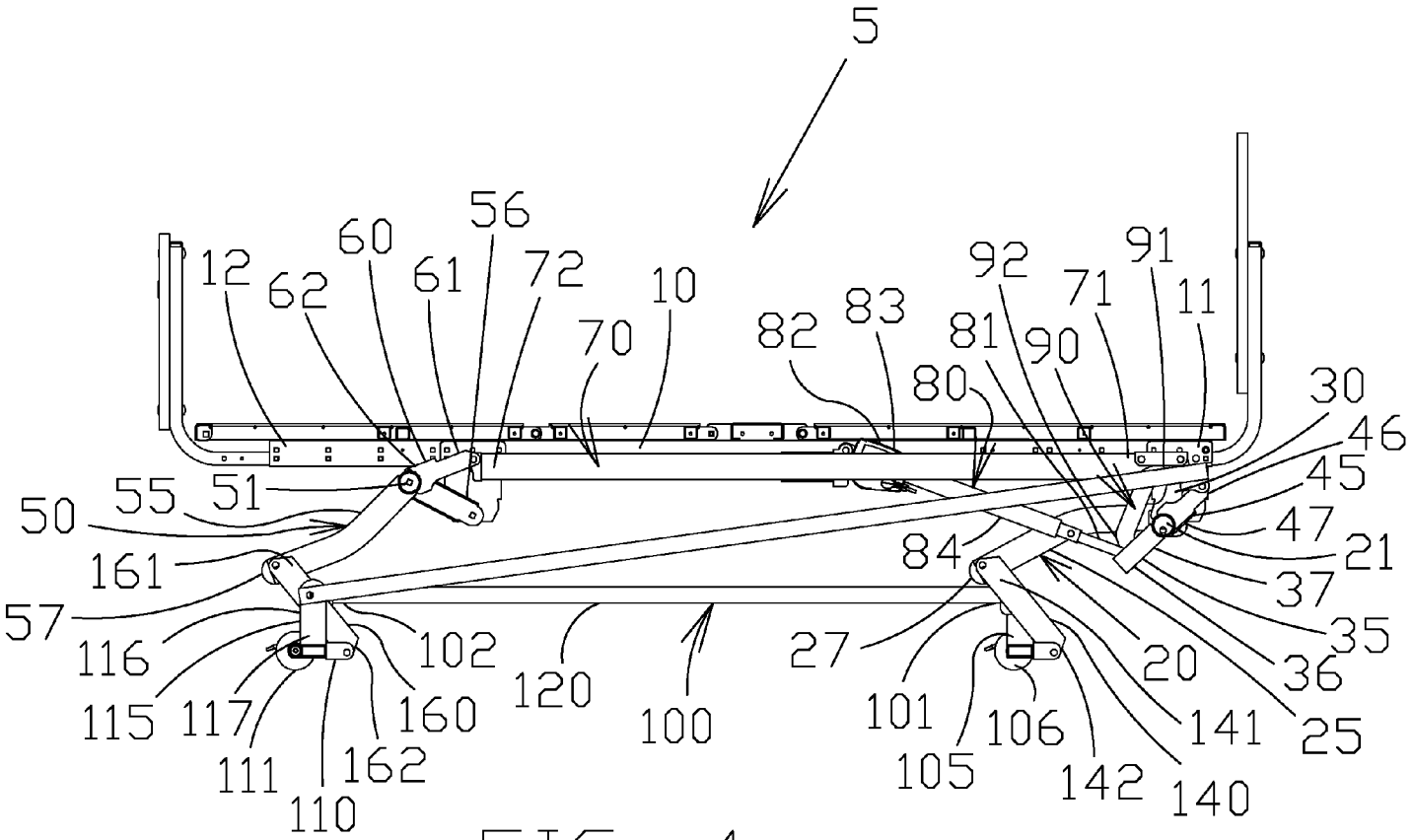
FIG. 4 is a side section view taken along line 4-4 in FIG. 3.
Figure 8:
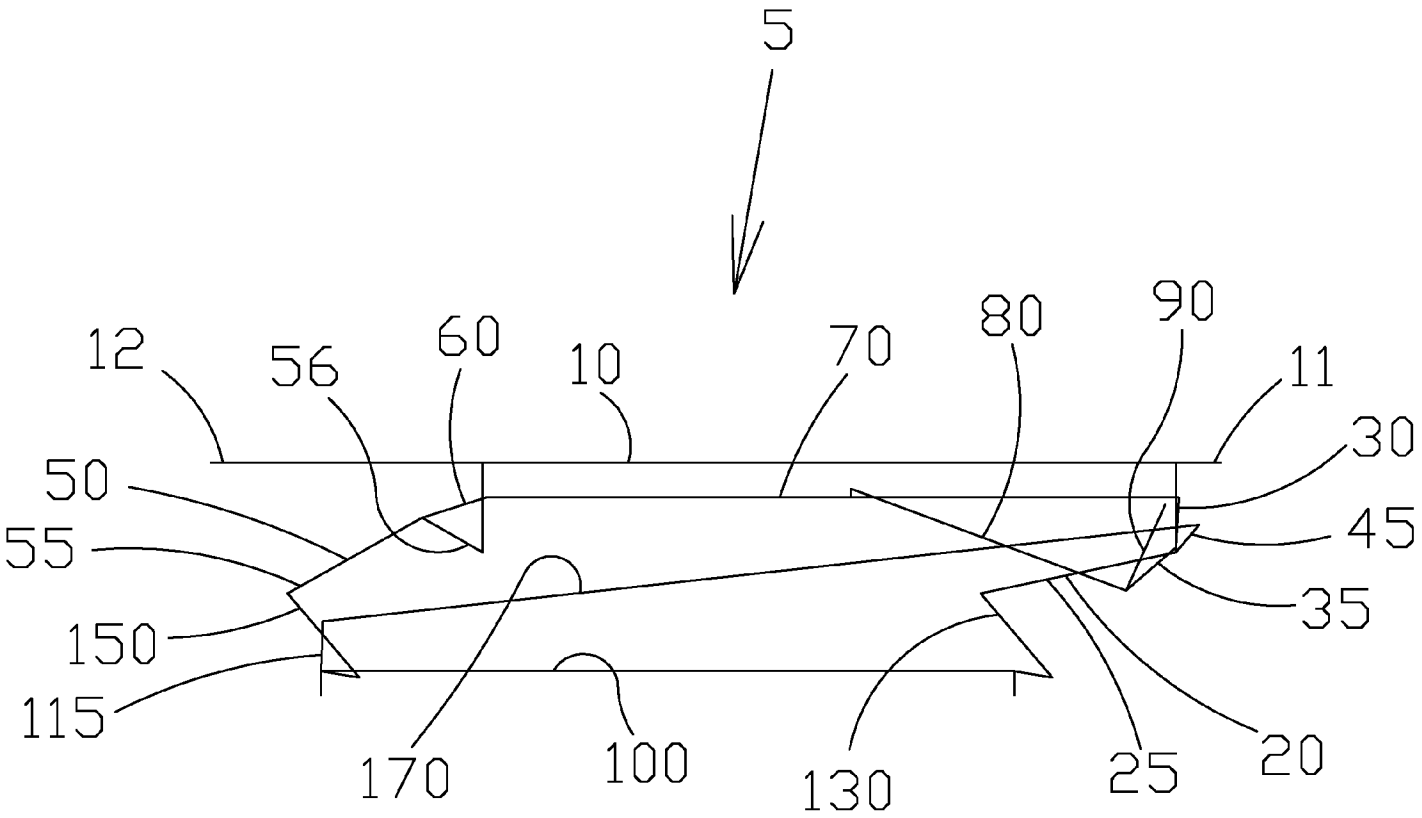
FIG. 8 is schematic view of the preferred embodiment of the present invention shown in FIG. 1 in a mid position.

The bed 5 is shown in a mid position in FIGS. 3, 4 and 8. While the bed 5 is rising, the first end 81 of the actuator 80 slides in the track 40 away from end 42 and towards end 41. This shortens the effective length of arm 35 to increase the ratio of lift to stroke, and increase the speed of rotation of arms 25, 30, 35 and 40 about the central axis. Increasing the ratio of lift to stroke maintains the output of the actuator near its peak capacity, and hence utilizes the actuator at or near peak efficiency.

Figure 2:
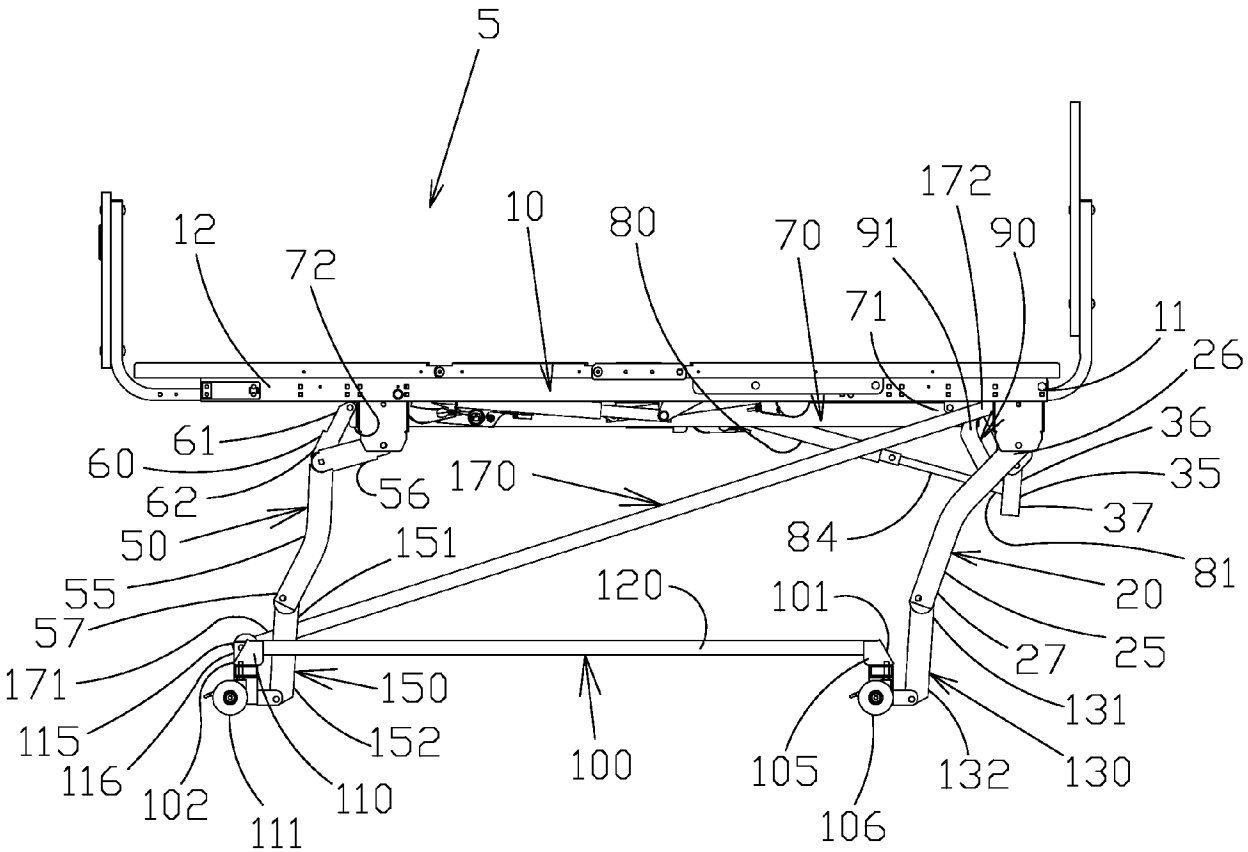
FIG. 2 is a side view of the preferred embodiment of the present invention shown in FIG. 1 in a high position.
Figure 7:
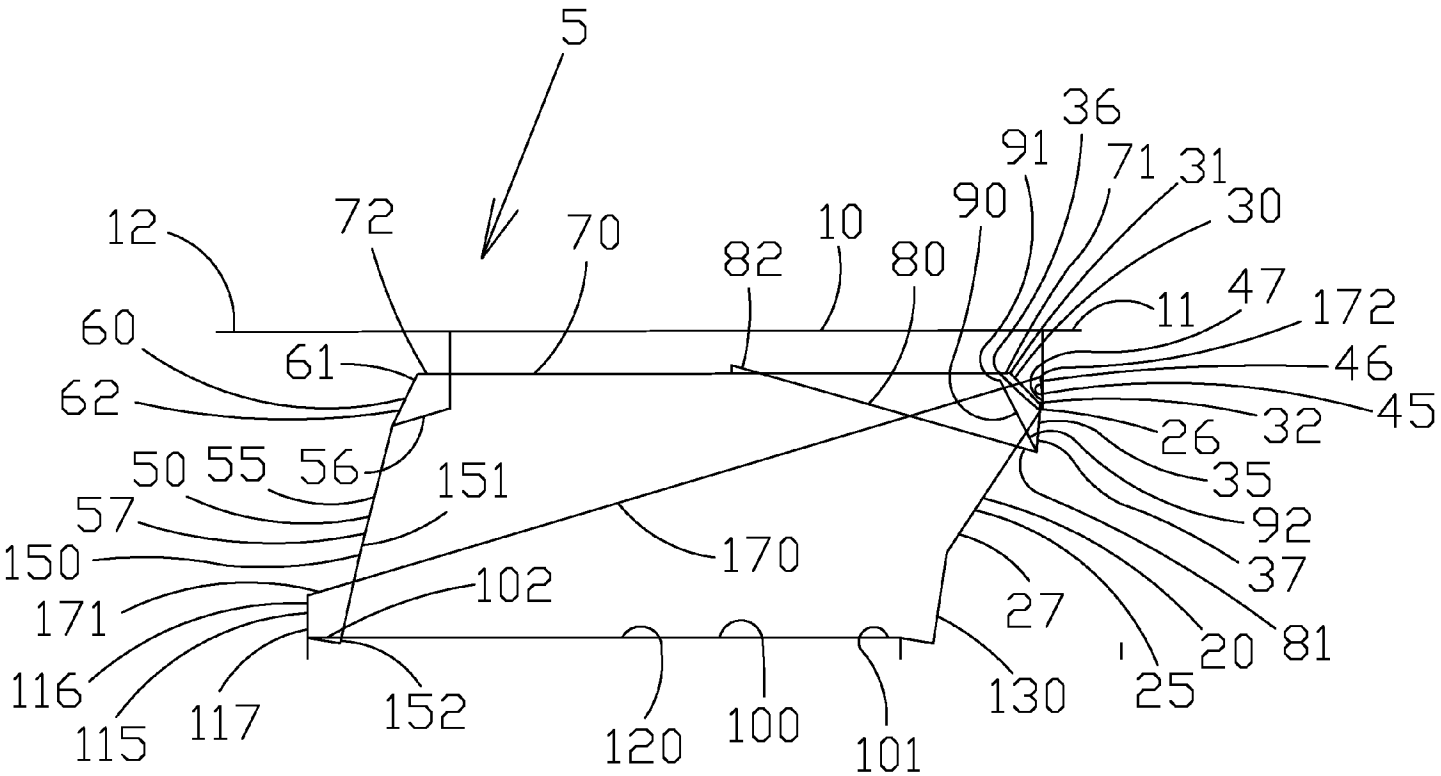
FIG. 7 is schematic view of the preferred embodiment of the present invention shown in FIG. 1 in a high position.

The first end 81 of the actuator approaches the first end 41 of the track as the bed 5 reaches the high position. The high position of the bed 5 is shown in FIGS. 1, 2 and 7.

It is appreciated that since the actuator 80 is connected to drag link 70, it is not directly connected to or fixed to the deck 10. Further, since the actuator is connected to arm 30, it is not directly connected to or fixed to a caster carriage 100 (described below). Accordingly, the actuator 80 is a floating actuator.

It is also appreciated that the first end 81 of the actuator 80 can preferably continuously slide with track 40 as the bed 5 is being raised or lowered. It is possible, but not required that the first end 81 of the actuator 80 slide within the track 40 at a constant rate.

The caster carriage 100 has a first end 101 and a second end 102. A base support 105 can be at the first end 101 of the caster carriage 100. The base support 105 can have two casters 107 connected thereto. A second base support 110 can also be provided, and is located at the second end 102 of the caster carriage 100. Base support 110 has casters 111 and an arm 115. Arm 115 has ends 116 and 117. The arm 115 is preferably rigidly connected to the base support 110, and is preferably generally vertically oriented. Longitudinal supports 120 are preferably provided between base support 105 and base support 110. It is appreciated that the caster carriage is but one type of caster support assembly. An alternative caster assembly may be used (e.g. without the longitudinal support) without departing from the broad aspects of the present invention. In this regard, two independent caster supports (one for each end) may be considered a single caster assembly.

Idlers 130, 140, 150 and 160 are further provided according to the present invention. Idler 130 has a first end 131 pivotally connected to end 27 of arm 25, and a second end 132 pivotally connected to base support 105. Idler 140 has a first end 141 pivotally connected to end 27 of arm 25, and a second end 142 pivotally connected to base support 105, as seen in FIG. 1. It is appreciated that idlers 130 and 140 operate in unison, and that it is preferable to have two idlers to provide stable support between the base and the first lever 20. However, more or fewer idlers may be used without departing from the broad aspects of the present invention.

Idler 150 has a first end 151 pivotally connected to end 57 of arm 55, and a second end 152 pivotally connected to base support 115. Idler 160 has a first end 161 pivotally connected to end 57 of arm 55, and a second end 162 pivotally connected to base support 115, as seen in FIG. 1. It is appreciated that idlers 150 and 160 operate in unison, and that it is preferable to have two idlers to provide stable support between the base and the second lever 50. However, more or fewer idlers may be used without departing from the broad aspects of the present invention.

It is understood that idlers 130 and 140 may act independent of idlers 150 and 160. In this regard, the idlers may have different lengths and may operate at different angles and rotational speeds without departing from the broad aspects of the present invention.

A radius arm 170, having ends 171 and 172, is further provided according to the present invention. The radius arm first end 171 is preferably pivotally connected to the second end 117 of arm 115. The second end 172 is preferably connected to the second end 47 of arm 45 of the first lever 20. It is appreciated that the orientation of the radius arm 170 within the overall bed 5 may be inverted (i.e. first end of radius arm connected to first caster carriage support and the second end of the radius arm connected to the second lever) without departing from the broad aspects of the present invention. It is further appreciated that the deck 10 may be inverted relative the remainder of the components without departing from the broad aspects of the present invention.

It is seen that second end 172 of the radius arm 170 is not connected to the deck 10. Accordingly, the second end 172 of the radius arm floats relative the deck.

In the preferred embodiment, the radius arm may be approximately about six feet long. It is understood that the radius arm may be longer or shorter than six feet without departing from the broad aspects of the present invention. Yet, it may be desirable to have a relatively long radius arm (compared to the overall bed length) in order to minimize the horizontal component of the movement as compared to the overall vertical movement of the second end of the radius arm. The longer the radius arm is, the longer the lever arm is needed to be in order to compensate for the horizontal shifting.

It is understood that while the radius arm is described as a rigid member, the radius arm may have a variable (but controlled) dimension and still be within the broad aspects of the present invention. It is further understood that the radius arm could be slideably and/or pivotally connected to the respective lever without departing from the broad aspects of the present invention.

Operation of the idlers 130, 140, 150 and 160, and operation of the radius arm can be observed by looking at the figures. It is understood that the radius arm 170 is a rigid member, and that rotation of the second end 47 of arm 45 of the first lever 20 follows a circular path around the second end 117 of arm 115 of base support 110 as the bed is raised and lowered. Yet, the deck 10 raises and lowers in a substantially vertical manner.

Moving from the low position to a point midway between the low and high positions, the idlers rotate in a first rotational direction about their lower pivot points, respectively. Then, from the midway point to the high position, the idlers rotate in the opposite rotational direction about their lower pivot points, respectively.

As noted, the second end 172 of the radius arm 170, being connected to an arm 45, floats within the bed. The horizontal movement of the deck is minimized in the overall vertical rise and lowering of the deck because the horizontal shift in one direction causes by the radius arm is effectively cancelled by the sum of the opposite horizontal shifting attributed to the rotation of arm 45 about the lever central axis, the rotation of the overall lever 20 about the deck, and the rotation of the idlers.

Thus it is apparent that there has been provided, in accordance with the invention, a height adjustable apparatus that fully satisfies the objects, aims and advantages as set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A height adjustable apparatus comprising:

a deck;

a first lever supporting said deck and being pivotally connected thereto;

a second lever supporting said deck and being pivotally connected thereto;

an actuator having an actuator first end and an actuator second end causing the deck to selectably raise and lower;

a caster assembly; and a radius arm having a radius arm first end and a radius arm second end, wherein said radius arm first end is connected to said caster assembly and said radius arm second end is connected to said first lever, wherein said radius arm second end floats relative said deck as said radius arm second end is not connected to said deck, and wherein said first lever is separated from said castor assembly by a first idler and a second idler, and said second lever is separated from said castor assembly by a third idler and a fourth idler.

2. The height adjustable apparatus of claim 1 wherein said caster assembly is a caster carriage having a first base support, a second base support and a longitudinal support.

3. The height adjustable apparatus of claim 2 wherein said second base support is at an end of said caster carriage and comprises a caster carriage arm, wherein said radius arm first end is pivotally connected to said caster carriage arm.

4. The height adjustable apparatus of claim 1 wherein said radius arm has a length approximately equal to six feet.

5. The height adjustable apparatus of claim 1 wherein:

said height adjustable apparatus has a low position, a mid position, and a high position; and said idlers rotate in a first rotational direction about the caster assembly between the low position and the mid position, and rotate in the opposite rotational direction about the caster assembly between the mid position and the high position.

6. The height adjustable apparatus of claim 5 wherein:

said radius arm causes a first horizontal shift; and the pivoting of said first lever about said deck, the rotation of said first lever about a first lever central axis, and the rotation of said idlers causes a second horizontal shift, and wherein said first horizontal shift is approximately equal and opposite to said second horizontal shift, whereby said deck accordingly raises and lowers substantially vertically.

7. The height adjustable apparatus of claim 1 wherein:

said first lever comprises:

a first lever first arm;

a first lever second arm;

a first lever third arm; and a first lever fourth arm; and said second lever comprises:

a second lever first arm; and a second lever second arm, wherein said radius arm second end is pivotally connected to said first lever fourth arm.

8. The height adjustable apparatus of claim 7 further comprising a drag link having a drag link first end and a drag link second end, said drag link first end being connected to said first lever second arm and said drag link second end being connected to said second lever second arm, wherein said drag link causes said first lever and said second lever to act in tandem.

9. The height adjustable apparatus of claim 8 further comprising an actuator having an actuator first end and an actuator second end, said actuator first end being pivotally connected to said first lever third arm and said actuator second end being pivotally connected to said drag link.

10. A height adjustable apparatus comprising:

a deck;

a first lever supporting said deck and being pivotally connected thereto;

a second lever supporting said deck and being pivotally connected thereto;

a caster assembly;

a plurality of idlers, at least one of said plurality of idlers being between said caster assembly and said first lever, and at least one other of said plurality of idlers being between said caster assembly and said second lever, respectively; and a radius arm having a radius arm first end and a radius arm second end, wherein said radius arm first end is connected to said caster assembly and said radius arm second end is connected to said first lever, wherein said radius arm second end floats relative said deck as said radius arm second end is not connected to said deck, wherein:

said radius arm causes a first horizontal shift; and the pivoting of said first lever about said deck, the rotation of said first lever about a first lever central axis, and the rotation of said idlers causes a second horizontal shift, and wherein said first horizontal shift is approximately equal and opposite to said second horizontal shift, whereby said deck accordingly raises and lowers substantially vertically.

11. The height adjustable apparatus of claim 10 wherein:

said height adjustable apparatus has a low position, a mid position, and a high position; and said plurality of idlers rotate in a first rotational direction about the caster assembly between the low position and the mid position, and rotate in the opposite rotational direction about the caster assembly between the mid position and the high position.

12. The height adjustable apparatus of claim 10 wherein:

said first lever comprises:

a first lever first arm;

a first lever second arm;

a first lever third arm; and a first lever fourth arm; and said second lever comprises:

a second lever first arm; and a second lever second arm, wherein said radius arm second end is pivotally connected to said first lever fourth arm.

13. The height adjustable apparatus of claim 12 wherein:

said caster assembly is a caster carriage having a caster carriage first end and a caster carriage second end, said radius arm being pivotally connected to said caster carriage at said caster carriage second end; and said radius arm first end is pivotally connected to said first lever fourth arm.

14. The height adjustable apparatus of claim 12 further comprising a drag link, said drag link having a drag link first end connected to said first lever second arm, and said drag link further having a drag link second end connected to said second lever second arm.

15. The height adjustable apparatus of claim 10 wherein said radius arm has a length of approximately six feet.

* * * * *

UNITED STATES PATENT AND TRADEMARK OFFICE

CERTIFICATE OF CORRECTION

PATENT NO. : 8,484,780 B1
APPLICATION NO. : 12/274320
DATED : July 16, 2013
INVENTOR(S) : John Edgerton It is certified that error appears in the above-identified patent and that said Letters Patent is hereby corrected as shown below:

In the Claims,

Column 8, Line 3, in Claim 10, please delete "said idlers" and insert -- said plurality of idlers -- therefore.

Signed and Sealed this
Seventeenth Day of March, 2015

Michelle K. Lee

Michelle K. Lee
*Director of the United States Patent and Trademark Office*